US007983600B2

(12) United States Patent
Abe et al.

(10) Patent No.: US 7,983,600 B2
(45) Date of Patent: Jul. 19, 2011

(54) IMAGE FORMING APPARATUS

(75) Inventors: Koji Abe, Nagoya (JP); Yohei Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 12/534,032

(22) Filed: Jul. 31, 2009

(65) Prior Publication Data

US 2010/0028046 A1 Feb. 4, 2010

(30) Foreign Application Priority Data

Jul. 31, 2008 (JP) ..... 2008-198428
Jan. 13, 2009 (JP) ..... 2009-004817
Jul. 21, 2009 (JP) ..... 2009-169805

(51) Int. Cl.
*G03G 15/00* (2006.01)

(52) U.S. Cl. ..... 399/167

(58) Field of Classification Search ..... 399/107, 399/116, 117, 159, 167, 299, 306
See application file for complete search history.

(56) References Cited

U.S. PATENT DOCUMENTS 4,796,050 A 1/1989 Furuta et al.
6,519,432 B1 * 2/2003 Matsumoto ..... 399/167
6,801,736 B2 * 10/2004 Senda ..... 399/167
7,120,376 B2 * 10/2006 Saito et al. ..... 399/167
2005/0013629 A1 1/2005 Ito et al.
2007/0196130 A1 8/2007 Okabe et al.

FOREIGN PATENT DOCUMENTS

JP S62-178988 A 8/1987
JP H08-194347 A 7/1996
JP H10-186851 A 7/1998
JP H11-030889 A 2/1999
JP 2002-182449 A 6/2002
JP 2002-244534 A 8/2002
JP 2004-109766 A 4/2004
JP 2005-037677 A 2/2005
JP 2005-215126 A 8/2005
JP 2007-219317 A 8/2007

OTHER PUBLICATIONS

Japan Patent Office, Office Action for Japanese Patent Application No. 2009-169805 (counterpart to above-captioned patent application), dated Nov. 2, 2010.

* cited by examiner

*Primary Examiner* — Hoan Tran
(74) *Attorney, Agent, or Firm* — Baker Botts L.L.P.

(57) ABSTRACT

An image forming apparatus is provided. The image forming apparatus includes a single drive source, at least four photosensitive drums, a plurality of drum drive gears which are provided to correspond to the photosensitive drums, and a plurality of intermediate gears which are interposed between the drive source and each of the drum drive gears. A number of the intermediate gears provided for each of the photosensitive drums is same.

20 Claims, 12 Drawing Sheets

IMAGE FORMING APPARATUS

CROSS-REFERENCE TO RELATED APPLICATION

This application claims priority from Japanese Patent Application Nos. 2008-198428, filed on Jul. 31, 2008, 2009-004817, filed on Jan. 13, 2009, and 2009-169805, filed on Jul. 21, 2009, the entire subject matter of which is incorporated herein by reference.

TECHNICAL FIELD

Aspects of the present invention relate to an image forming apparatus such as a color laser printer.

BACKGROUND

As an electrophotographic color laser printer, there is known a tandem color laser printer which includes four photosensitive drums corresponding to toner of four colors such as yellow, magenta, cyan and black, respectively.

In the tandem color laser printer, since toner images of those four colors are formed individually on the corresponding photosensitive drums substantially simultaneously, a color image can be formed at almost the same speed as that at which a monochrome image is formed in a monochrome laser printer.

An image forming apparatus which is a tandem color laser printer includes two motors, a pair of transmission gears provided for each motor and four drum gears provided for the transmission gears, respectively. In the image forming apparatus, the four drum gears are driven by the two motors through the transmission gears. Phases of the pair of transmission gears are shifted from each other by a predetermined angle and the drive of the motors is controlled so that the phases of the transmission gears are synchronized, and occurrence of color registration error can be reduced or prevented.

An image forming apparatus includes four drum drive gears corresponding to four photosensitive drums, respectively, three idle gears provided between the four drum drive gears, respectively so that each of the idle gears meshes with the pair of drum drive gears adjacent thereto, and a gear of a drive motor provided to mesh with one of the drum drive gears. According to this configuration, the driving force of the drive motor transmitted to the one of the drum drive gears is further transmitted to the three remaining drum drive gears via the idle gears and the drum drive gears, whereby the respective photosensitive drums are rotated.

In such a tandem color laser printer, toner images of four colors are overlapped sequentially. Therefore, in order to reduce or prevent color registration error occurring during the overlapping of the toner images, it is important that the toner images are overlapped with the same printing errors occurring in the respective colors. Accordingly, it is advantageous that the photosensitive drums corresponding to the four colors are driven under the same conditions.

In the image forming apparatus as described above firstly, the two motors are provided, and the drive of the two motors are controlled in order to synchronize the phases of the transmission gears. That is, the image forming apparatus needs the two motors and two sensors for controlling the drive of the two motors, which makes the configuration of the image forming apparatus complex. Additionally, this configuration causes increase in the production cost of the image forming apparatus.

In the image forming apparatus as described above secondly, since the number of gears provided between the motor and the photosensitive drums are different with each other, the production errors in the respective gears affect the photosensitive drums differently, and the photosensitive drums cannot be rotated in the synchronized manner, which causes a fear that color registration errors are generated.

SUMMARY

Accordingly, it is an aspect of the present invention to provide an image forming apparatus in which color registration errors between at least four photosensitive drum can be reduced by a simple configuration.

According to an exemplary embodiment of the present invention, there is provided an image forming apparatus comprising: a single drive source; at least four photosensitive drums; a plurality of drum drive gears which are provided to correspond to the photosensitive drums; and a plurality of intermediate gears which are interposed between the drive source and each of the drum drive gears. A number of the intermediate gears provided for each of the photosensitive drums is same.

According to another exemplary embodiment of the present invention, there is provided an image forming apparatus comprising: four drum drive gears which are connectable to one ends of four photosensitive drums in an axis direction thereof, respectively, and which are arranged at an interval therebetween along a substantially straight line extending in an arrangement direction which is substantially orthogonal to the axes of the drum drive gears, the axes of the drum drive gears extending parallel to each other; a single drive source which supplies a drive force to the photosensitive drums to rotate about the axes thereof, respectively; and a plurality of intermediate gears which are interposed between the drive source and each of the drum drive gears. When the four drum drive gears are divided into two groups, each including two adjacent drum drive gears, a gear non-rotatably connected to the drive source is provided at a substantially center position between the two groups in the arrangement direction. The plurality of intermediate gears include: a first intermediate gear which is provided for each of the two groups and meshes with the two drum drive gears of the corresponding group, and a second intermediate gear which is provided for each of the two groups and connects the first intermediate gear for the corresponding group with the gear non-rotatably connected to the drive source.

According to another exemplary embodiment of the present invention, there is provided an image forming apparatus comprising: four drum drive gears which are connectable to one ends of four photosensitive drums in an axis direction thereof, respectively, and which are arranged at an interval therebetween along a substantially straight line extending in an arrangement direction which is substantially orthogonal to the axes of the drum drive gears, the axes of the drum drive gears extending parallel to each other, a single drive source which supplies a drive force to the photosensitive drums to rotate about the axes thereof, respectively; and a plurality of intermediate gears which are interposed between the drive source and each of the drum drive gears. The plurality of intermediate gears include: a first intermediate gear which is provided for each of two groups into which the four drum drive gears are divided, each group including two adjacent drum drive gears, and which meshes with the two drum drive gears of the corresponding group; a second intermediate gear which is provided for each of the two groups and is connected to the first intermediate gear for the corresponding group; and a third intermediate gear which is provided at a substantially center position between the two groups in the arrangement direction, and which connects the second intermediate gears with a gear non-rotatably connected to the drive source.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described with reference to the accompanying drawings.

1. Overall Configuration of Color Laser Printer

Figure 1:
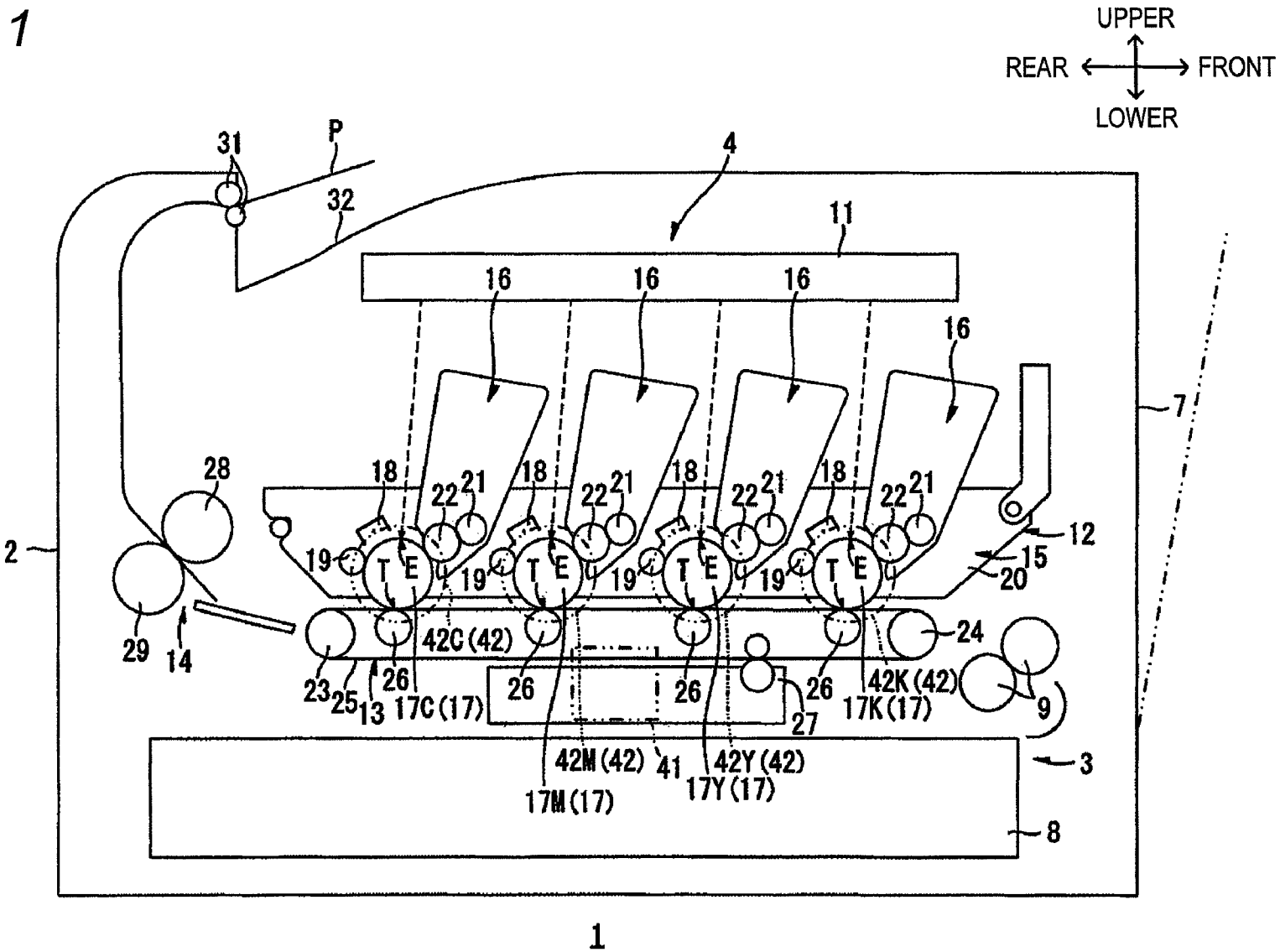
FIG. 1 is a side sectional view of a color laser printer according to exemplary embodiments of the present invention.

As shown in FIG. 1, a color laser printer 1 is a horizontal tandem color laser printer and includes a body casing 2, a feeder unit 3 for feeding sheets P, and an image forming unit 4 for forming an image on a sheet P within the body casing 2.

(1) Body Casing 2

The body casing 2 has a box shape, which has a rectangular shape when viewed from a lateral side, so as to accommodate the image forming unit 4. A front cover 7 is provided on one of side walls of the body casing 2 for installation or removal of a process unit 12, which will be described later.

It is noted that in the following description, the side (a right side in FIG. 1) of the color laser printer where the front cover 7 is provided is referred to as a front side, an opposite side (a left side in FIG. 1) is referred to as a rear side, and an upper side and a lower side of the color laser printer 1 in FIG. 1 are referred to as an upper side and a lower side, respectively. Further, left and right sides are described based on a situation in which the laser printer 1 is seen from the front side thereof. That is, the front side of a sheet of FIG. 1 is referred to as a left side, and a back side of the sheet of FIG. 1 is referred to as a right side of the color laser printer 1. Additionally, a left-right direction is referred to as a width direction in some cases.

(2) Feeder Unit 3

The feeder unit 3 includes a sheet feeding tray 8 which accommodates sheets P. The sheet feeding tray 8 is detachably installed at a bottom portion in an interior of the body casing 2. A sheet feeding roller (not shown) is disposed above a front end portion of the sheet feeding tray 8, and registration rollers 9 are disposed above the sheet feeding roller.

Sheets P accommodated in the sheet feeding tray 8 are fed toward the registration rollers 9 one by one. Thereafter, the sheets P are transported toward the image forming unit 4 (between photosensitive drums 17 and a transportation belt 25) by the registration rollers 9.

(3) Image Forming Unit 4

The image forming unit 4 includes a scanner unit 11, the process unit 12, a transfer unit 13 and a fixing unit 14.

(3-1) Scanner Unit 11

The scanner unit 11 is disposed at an upper portion of the body casing 2. As is indicated by broken lines, the scanner unit 11 emits individually laser beams based on image data toward the four photosensitive drums 17, so as to expose the photosensitive drums 17.

(3-2) Process Unit 12

The process unit 12 is disposed below the scanner unit 11 and above the feeder unit 3 and includes one drum unit 15 and four developing cartridges 16 which correspond to four colors such as yellow, magenta, cyan and black. The process unit 12 is detachably installed in the body casing 2 by being inserted or pulled out along a front-rear direction.

(3-2-1) Drum Unit 15

The drum unit 15 includes a drum frame 20, the four photosensitive drums 17 which correspond to the four colors, respectively, and four scorotron-type chargers 18 and four cleaning rollers 19 which correspond to the photosensitive drums 17, respectively.

The drum frame 20 includes a pair of side plates which are disposed to oppose each other in the left-right direction with a space therebetween.

The photosensitive drums 17 are supported between the side plates of the drum frame 20 to be rotatable about their axes which extend substantially horizontally in the left-right direction and are arranged in the front-rear direction with an interval therebetween. Specifically, the photosensitive drum 17K for black, the photosensitive drum 17Y for yellow, the photosensitive drum 17M for magenta and the photosensitive drum 17C for cyan are disposed sequentially in order from the front side toward the rear side of the laser printer 1. The photosensitive drums 17 have the same diameter.

Each scorotron-type charger 18 is disposed to lie obliquely upward and rearward of the corresponding photosensitive drum 17 so as to oppose the photosensitive drum 17 with a space therebetween.

Each cleaning roller 19 is disposed to be in contact with the corresponding photosensitive drum 17 at the rear of the photosensitive drum 17.

Further, the individual scorotron-type chargers 18 and cleaning rollers 19 are supported on center frames (not shown) which are provided so as to extend between the side plates of the drum frame 20.

(3-2-2) Developing Cartridges 16

The four developing cartridges 16 are provided detachably in the drum units 15 so as to correspond to the four photosensitive drums 17, respectively.

Each developing cartridge 16 includes a supply roller 21, a developing roller 22 and a layer thickness controlling frame (not shown) and accommodates therein toner as developer which corresponds to one of the four colors.

(3-2-3) Developing Operation in Process Unit 12

Toner within an interior of the developing cartridge 16 is supplied to the supply roller 21 and is supplied further to the developing roller 22, and is friction charged positively between the supply roller 21 and the developing roller 22.

The thickness of toner that is supplied to the developing roller 22 is controlled by the layer thickness control blade (not shown) as the developing roller 22 rotates, and the toner is then carried on a surface of the developing roller 22 as a thin layer of a constant thickness.

A surface of each photosensitive drum 17 which opposes the corresponding developing cartridge 16 is positively charged in a uniform manner by the corresponding scorotron-type charger 18 as the photosensitive drum 17 rotates, and thereafter, the surface of the photosensitive drum 17 is exposed in an exposure position E by a laser beam (indicated by a broken line in the figure) which is emitted from the scanner unit 11 to scan the surface at a high speed. Accordingly, an electrostatic latent image corresponding to an image that is to be formed on a sheet P is formed on the surface of the photosensitive drum 17.

When the photosensitive drum 17 rotates further, the toner which is carried on the surface of the developing roller 22 and is charged positively is supplied to the electrostatic latent image which is now formed on the surface of the photosensitive drum 17. Accordingly, the electrostatic latent image on the photosensitive drum 17 is visualized, and a toner image corresponding to one of the four colors is developed by reversal development and is carried on the surface of the photosensitive drum 17.

(3-3) Transfer Unit 13

The transfer unit 13 is disposed above the feeder unit 3 and below the process unit 12 in the interior of the body casing 2 and extends along the front-rear direction. This transfer unit 13 includes a drive roller 23, a driven roller 24, the transportation belt 25, transfer rollers 26 and a cleaning part 27.

The drive roller 23 and the driven roller 24 are disposed so as to be spaced apart in the front-rear direction to oppose each other, and the transportation belt 25, which is made up of an endless belt, is wound around the driver roller 23 and the driven roller 24.

Each of the transfer rollers 26 is provided so as to oppose the corresponding photosensitive drum 17 with the transportation belt 25 therebetween.

The cleaning part 27 is disposed below the transportation belt 25 which is wound around the drive roller 23 and the driven roller 24.

Then, a sheet P which is fed out of the feeder unit 3 is transported by the transportation belt 25 from the front side toward the rear side of the color laser printer 1 while passing sequentially through transfer positions T by the photosensitive drums 17. During the transportation, toner images of the four colors which are carried on the photosensitive drums 17 are transferred sequentially on to the sheet P to thereby form a color image on the sheet P.

In the transfer operation, toner which attached to the surface of the transportation belt 25 is removed at the cleaning part 27.

(3-4) Fixing Unit 14

The fixing unit 14 is disposed at the rear of the transfer unit 13 and includes a heating roller 28 and a pressing roller 29 provided to oppose the heating roller 28. The color image which has been transferred on to the sheet P in the transfer unit 13 is thermally fixed to the sheet P while being heated and pressed by the heating roller 28 and the pressing roller 29.

(4) Sheet Discharging

The sheet P on which the toner images has been fixed is transported toward sheet discharging rollers 31 and is then discharged onto a sheet discharging tray 32 which is defined on an upper surface of the body casing 2 by the sheet discharging rollers 31.

2. Photosensitive Drum Drive System (2-1) Details of Drive System

Figure 3:
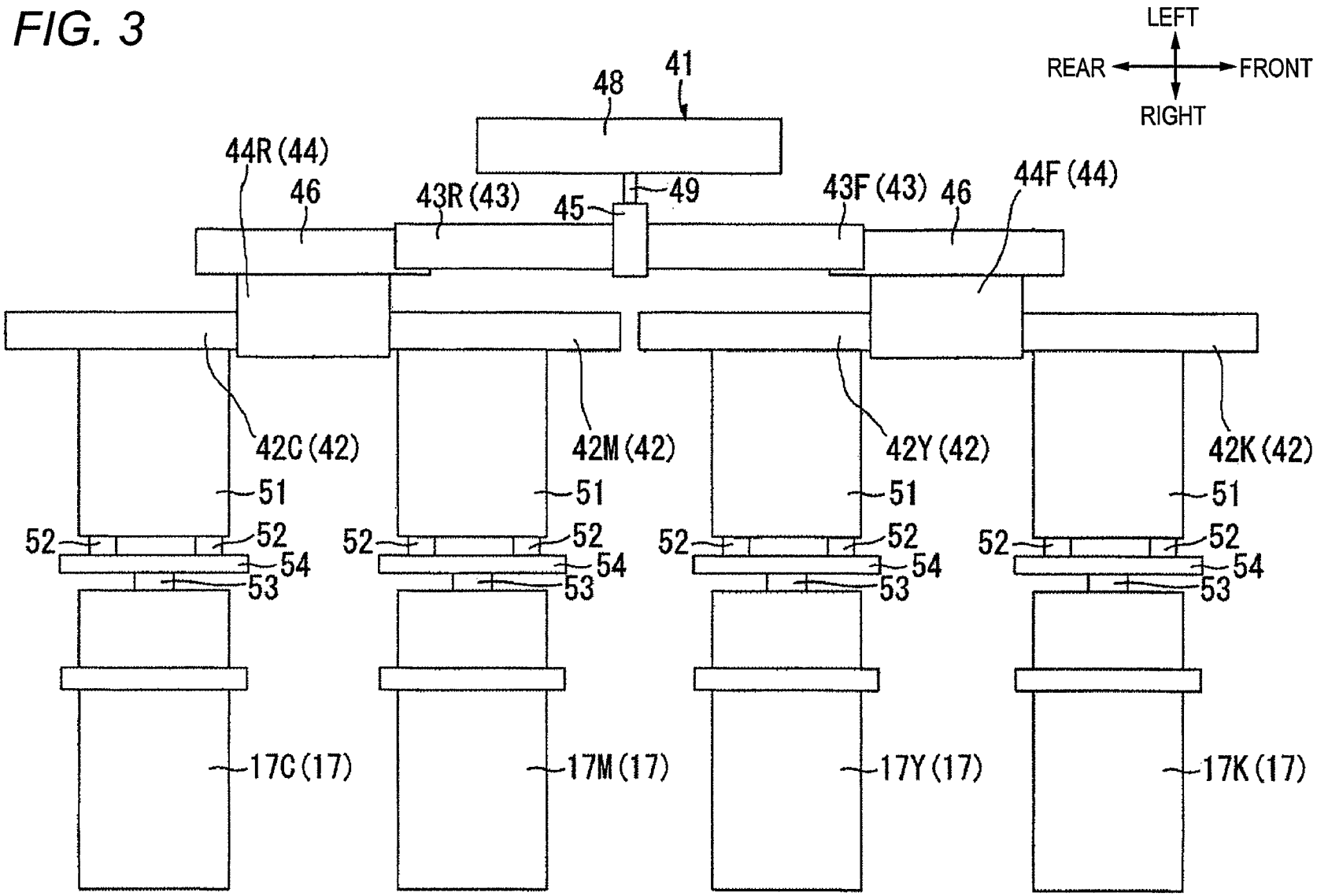
FIG. 3 is a bottom view of the gear train and the photosensitive drums shown in FIG. 2.

The color laser printer 1 includes, as indicated by the imaginary lines (chain double-dashed lines) in FIG. 1, a single motor 41, which is an example of a drive source, and four drum drive gears 42 provided to oppose the photosensitive drums 17, respectively. Each drum drive gear 42 is provided to be rotatable about an axis which is parallel to the axis of the corresponding photosensitive drum 17 and is positioned substantially on an extension thereof. Specifically, the four drum drive gears 42 include a drum drive gear 42 corresponding to the black photosensitive drum 17 (hereinafter, referred to as a black drum drive gear 42K), a drum drive gear 42 corresponding to the yellow photosensitive drum 17Y (hereinafter, referred to as a yellow drum drive gear 42Y), a drum drive gear 42 corresponding to the magenta photosensitive drum 17M (hereinafter, referred to as a magenta drum drive gear 42M), and a drum drive gear 42 corresponding to the cyan photosensitive drum 17C (hereinafter, referred to as a cyan drum drive gear 42C). Each of the four drum drive gears 42 has the same diameter and the same tooth profile and are arranged on a vertical plane which is parallel to an arrangement direction in which the four photosensitive drums 17 are arranged in order as shown in FIG. 3. In other words, the drum drive gears 42 are provided at a same position in the axis direction of the photosensitive drums 17.

Figure 2:
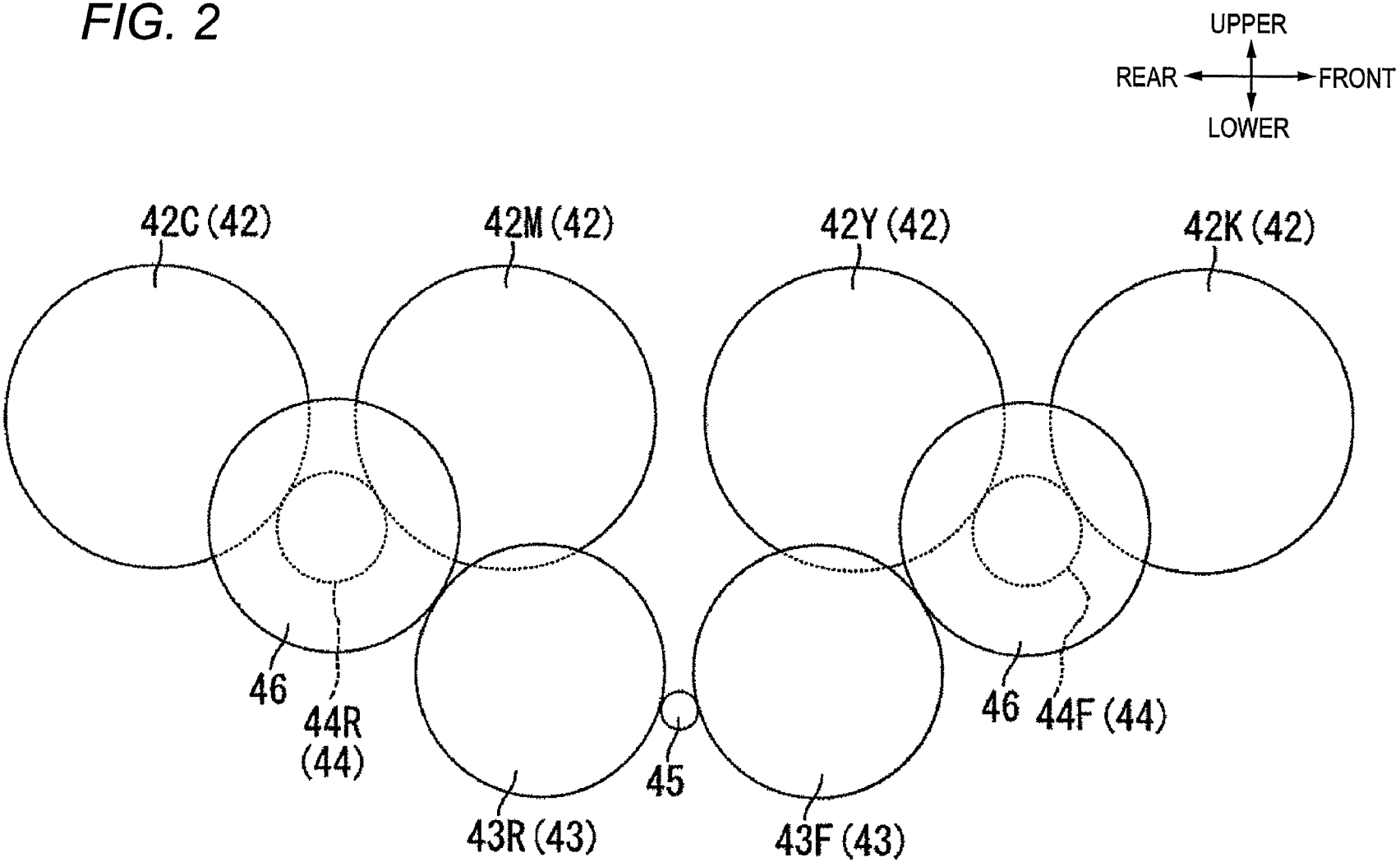
FIG. 2 is a schematic left side view of a gear train according to a first exemplary embodiment which transmits a drive force from a motor to photosensitive drums shown in FIG. 1.

As shown in FIG. 2, the color laser printer 1 includes first intermediate gears 44 and second intermediate gears 43 as examples of intermediate gears, and these first and second intermediate gears 44, 43 configures a gear train as an example of a transmission element which is interposed between the motor 41 and the drum drive gears 42.

As shown in FIG. 3, the motor 41 is provided on a left side of the drum unit 15 and includes a motor main body 48 and a drive shaft 49 which projects rightward from the motor main body 48 in parallel to the axes of the drum drive gears 42. A pinion gear 45 is connected to the drive shaft 49 so as not to rotate (fixed) relative to the drive shaft 49. The four drum drive gears 42 are divided into two groups, each including two adjacent drum drive gears 42 in the arrangement direction in which the drum drive gears 42 are arranged. As shown in FIG. 2, the pinion gear 45 is provided at a substantially center position between the two groups in the arrangement direction of the drum drive gears 42 as viewed from the top thereof.

Two of the first intermediate gears 44 are provided at front and rear positions. Hereinafter, when describing about a positional relationship in the front-rear direction between the two first intermediate gears, the first intermediate gear in the front position is referred to as a front first intermediate gear 44F, and the first intermediate gear in the rear position is referred to as a rear first intermediate gear 44R. The front and rear first intermediate gears are provided to be rotatable about their axes which are parallel to the axes of the drum drive gears 42, respectively. Specifically, as viewed in the arrangement direction of the drum drive gears 42, the axis of the front first intermediate gear 44F is arranged between the black drum drive gear 42K which is provided frontmost and the yellow drum drive gear 42Y which lies adjacent to and paired with the black drum drive gear 42K, and the front first intermediate gear 44F meshes with both the drum drive gears 42K, 42Y. Additionally, as viewed in the arrangement direction of the drum drive gears, the axis of the rear first intermediate gear 44R is arranged between the magenta drum drive gear 42M which is provided further rearward and the cyan drum drive gear 42C which lies adjacent to or paired with the magenta drum drive gear 42M, and the rear first intermediate gear 44R meshes with both the drum drive gears 42M, 42C.

A gear portion 46 is connected to each of the first intermediate gears 44F, 44R integrally and concentrically therewith.

Two of the second intermediate gears 43 are provided so as to lie further midway in the arrangement direction of the drum drive gears 42 than the first intermediate gears 44. In other words, the second intermediate gears 43 are provided closer to the pinion gear 45 than the first intermediate gears 44. Hereinafter, when describing about a positional relationship in the front-rear direction between the two second intermediate gears 43, the second intermediate gear in a front position is referred to as a front second intermediate gear 43F, and the second intermediate gear in a rear position is referred to as a rear second intermediate gear 43R. The second intermediate gears 43 are provided to be rotatable around their axes which are parallel to the axes of the drum drive gears 42, respectively. Specifically, the axis of the front second intermediate gear 43F is arranged between the gear portion 46 which is concentric with the front first intermediate gear 44F and the pinion gear 45 of the motor 41, and the front second intermediate gear 43F meshes with the gear portion 46 and the pinion gear 45. The rear second intermediate gear 43R is arranged between the gear portion 46 which is concentric with the rear first intermediate gear 44R and the pinion gear 45 of the motor 41, and the rear second intermediate gear 43R meshes with the gear portion 46 and the pinion gear 45.

That is, the gear train transmits the drive force of the motor 41 from the pinion gear 45 of the motor 41 to the four drum drive gears 42 respectively via the same numbers of gears each including the second intermediate gear 43, the gear portion 46, and the first intermediate gear 44. In other words, the number of gears interposed between the motor 41 and each of the drum drive gears 42 is same. Further, since the front first intermediate gear 44F meshes commonly with the black and yellow drum drive gears 42K and 42Y which configure a front group of drum drive gears 42 via the gear portion 46 and the front second intermediate gear 43F which are used commonly between the drum drive gears 42 of the front group, the drive force can be transmitted to the black and yellow photosensitive drums 17K, 17Y under the same conditions. Similarly, the rear first intermediate gear 44R meshes commonly with the magenta and cyan drum drive gears 42M and 42C which configure a rear group of drum drive gears 42 and the gear portion 46 and the rear second intermediate gear 43R are used commonly between the drum drive gears 42 of the rear group, the drive force can be transmitted to the magenta and cyan photosensitive drums 17M, 17C under the same conditions. That is, errors in transmitting the drive force to the front and rear pairs of photosensitive drums 17 can be reduced, and therefore, printing errors can be reduced.

Further, the front second intermediate gear 43F, the gear portion 46 and the front first intermediate gear 44F and the rear second intermediate gear 43R, the gear portion 46 and the rear first intermediate gear 44R are arranged symmetrically with respect to the pinion gear 45 for the front group including the drum drive gears 42K, 42Y and the rear group including the drum drive gears 42M, 42C. According to this configuration, the four drum drive gears 42, the front second intermediate gear 43F and the rear second intermediate gear 43R, and the front gear portion 46, the front first intermediate gear 44F, the rear gear portion 46 and the rear first intermediate gear 44R can be formed as common parts, respectively, whereby errors in transmitting the drive force of the motor 41 to the front group of the drum drive gears 42K, 42Y and the rear group of the drum drive gears 42M, 42C can be reduced, and hence, printing errors can be reduced.

Further, the gears provided at the same sequential number from the pinion gear 45 can be molded by the same mold. That is, the four drum drive gears 42 can be molded by the same mold. The two first intermediate gears 44 and the gear portions 46 can be integrally molded by the same mold, respectively. The two second intermediate gears 43 can be molded by the same mold.

The first intermediate gears 44 and the second intermediate gears 43 are configured so that an integral multiple of the rotational cycle of each of the first intermediate gears 44 and the second intermediate gears 43 correspond to a time taken by each photosensitive drum 17 to rotate from the exposure position E to the transfer position T. That is, even if the rotational speeds of the gears 45, 43, 46, 44 are caused to vary periodically due to the eccentricity of those gears, the rotational cycles of the first intermediate gears 44 and the second intermediate gears 43 are substantially synchronized with the time taken by each of the photosensitive drums 17 to rotate from the exposure position B to the transfer position T, whereby the time taken by each of the photosensitive drums 17 to rotate from the exposure position E to the transfer position T can be prevented from varying between the photosensitive drums 17. Further, the circumferential speeds at the exposure position E and the transfer position T of each photosensitive drum 17 can be made to coincide substantially with each other. Accordingly, the printing errors at the four photosensitive drums 17 can be reduced further.

(2-2) Connecting Mechanism Between Gears and Photosensitive Drums

The four drum drive gears 42 each includes a connecting portion 51 which projects toward the corresponding photosensitive drum 17 in parallel to the axis of each of the drum drive gears 42. The connecting portions 51 each has a cylindrical shape and includes two projecting portions 52 which are provided in radially spaced positions on an end face thereof which opposes the corresponding photosensitive drum 17 and which project rightward (toward the corresponding photosensitive drum 17). The projecting portions 52 are made to advance or retreat in the left-right direction parallel to the axial direction of the drum drive gear 42 by a related-art advancing and retreating mechanism, respectively.

The photosensitive drums 17 each including a drum shaft 53, which projects in parallel to the axis thereof and supports the photosensitive drum 17 to be not rotatable relatively (fixed), and a disc-like coupling plate 54, which is provided at an end portion of the drum shaft 53 opposing the drum drive gear 42 to be rotatable integrally. Two through holes are formed in radially spaced positions on the coupling plate 54 so as to correspond to the projecting portions 52.

When the drum unit 15 is installed in the body casing 2, the two projecting portions 52 advance rightward to fit in the two through holes in the coupling plate 54, respectively, whereby the drum drive gear 42 is connected to the corresponding photosensitive drum 17 so as not to rotate relative to the photosensitive drum 17.

When the drum unit 15 is removed from the body casing 2, the projecting portions 52 retreat toward the drum drive gear 42 side and are disengaged from the corresponding through holes in the coupling plate 54, whereby the connection between the drum drive gear 42 and the photosensitive drum 17 is released.

(2-3) Phase Matching of Photosensitive Drums

Figure 4:
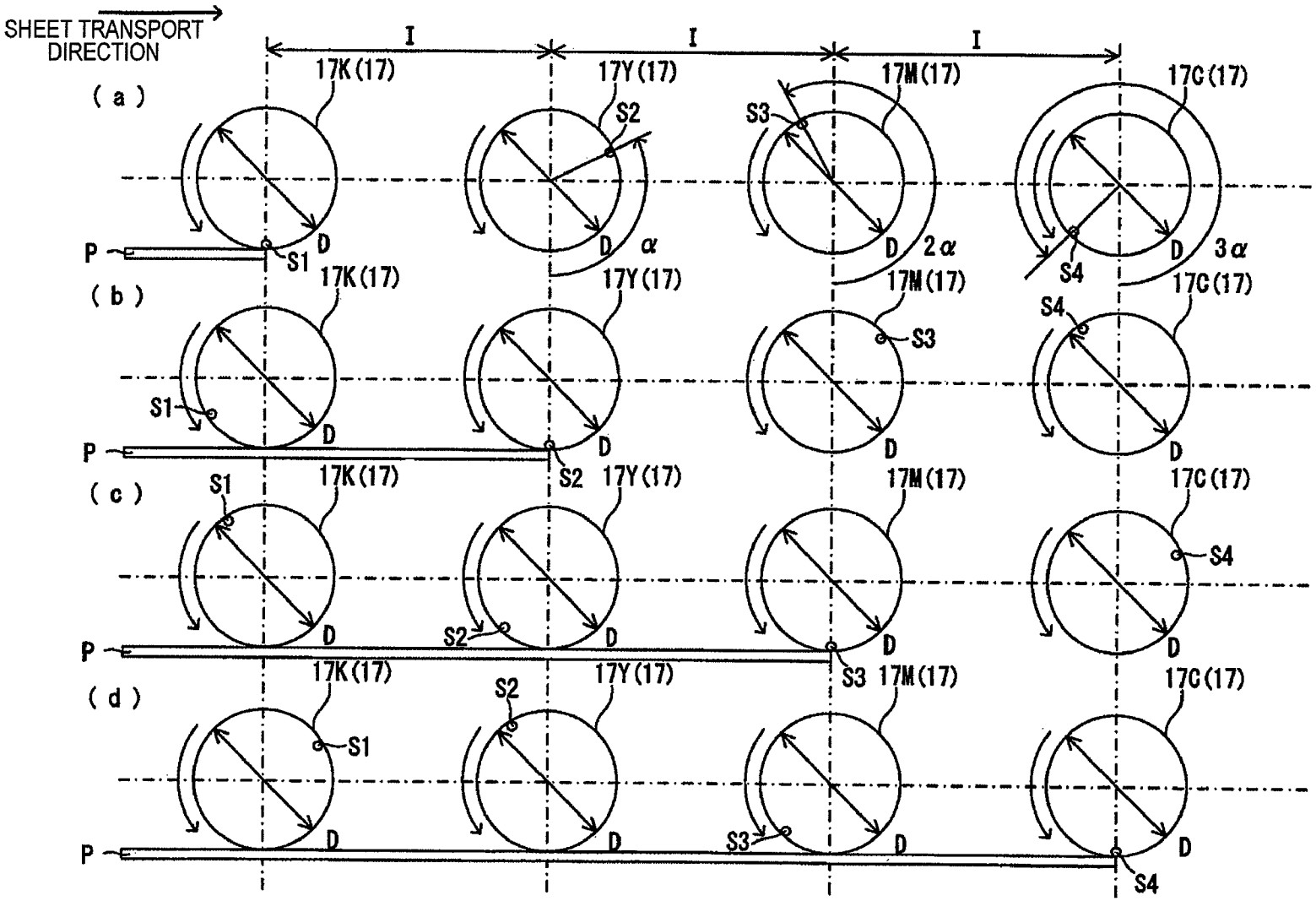
FIG. 4 is an explanatory diagram for explaining respective phases of the photosensitive drums.

As is shown in (a) of FIG. 4, in the color laser printer 1, when a phase of the drum drive gear 42 which is provided most upstream in the sheet transporting direction (that is, the black drum drive gear 42K) is regarded as a base phase, the drum drive gear 42 adjacent to the black drum drive gear 42K on a downstream side in the sheet transporting direction (that is, the yellow drum drive gear 42Y) is provided so that a phase of the yellow drum drive gear 42Y is shifted by a rotational angle α° denoted in the following expression from with respect to the base phase.

$$\alpha^\circ=(I-\pi D)/\pi D\times 360^\circ$$

where,

I: distance between rotational centers of the adjacent photosensitive drums;

D: diameter of the photosensitive drum.

That is, when subtracting the circumference πD of the photosensitive drum 17 from the distance between the rotational centers of the adjacent photosensitive drums 17, a residual distance of the distance is obtained over which the photosensitive drum 17 has to rotate. Then, the obtained residual distance is divided by the circumference πD of the photosensitive drum 17, and thereafter, a quotient resulting from the division is multiplied by 360°, whereby a shift angle (rotational angle) α° of the photosensitive drum 17 is obtained, which corresponds to the residual distance.

Based on the phase of the black drum drive gear 42K which is regarded as the base phase, by controlling the phase of the yellow drum drive gear 42Y to shift by the shift angle (rotational angle) α° with respect to the base phase, the phases of the black drum drive gear 42K and the yellow drum drive gear 42Y can be matched on a sheet P.

More specifically, firstly, the black drum drive gear 42K is provided, a base phase point S1' (not shown) of the black drum drive gear 42K is set so as to correspond to a contact point S1 of the black photosensitive drum 17 which is a first contact point with a sheet P transported. The contact points S of the respective photosensitive drums 17 and the base phase points S' (not shown) of the drum drive gears 42 are set so as to completely coincide, respectively, when viewed in the axis direction of the photosensitive drums 17.

Since the black drum drive gear 42K and the yellow drum drive gear 42Y are molded from the same mold as described above, for example, positions on the gears to be molded, which correspond to specific positions within the mold are set as a base phase point S1' (not shown) in the black drum drive gear 42K and a base phase point S2' (not shown) in the yellow drum drive gear 42Y, respectively. Then, the yellow drum drive gear 42Y is provided so that the base phase point S2' (not shown) shifts by α° from the base phase point S1' (not shown) which is a base point (0°).

It is noted that when the yellow drum drive gear 42Y is provided to shift by α° as described above, the phase of the yellow photosensitive drum 17Y also shifts by α° with respect to the black photosensitive drum 17K.

When the yellow drum drive gear 42Y is provided to shift by α°, the phase of the yellow photosensitive drum 17Y also shifts by α° with respect to the phase of the black photosensitive drum 17K.

By the yellow drum drive gear 42Y being disposed in the above-described manner with respect to the black drum drive gear 42K, when the sheet P has passed through the black photosensitive drum 17K to be transported to the yellow photosensitive drum 17Y as shown in (b) of FIG. 4, the phase of the contact point S2 of the yellow photosensitive drum 17Y has reached the phase of the contact point S1 (0°) of the black photosensitive drum 17K shown in (a) of FIG. 4, whereby the contact point S2 of the yellow photosensitive drum 17Y which corresponds to the contact point S1 of the black photosensitive drum 17K first comes into contact with the sheet P so transported.

Similarly, as shown in (c) of FIG. 4, the magenta drum drive gear 42M is provided so that the phase thereof shifts by α° with respect to the phase of the yellow drum drive gear 42Y, that is, shifts by 2α° with respect to the base phase. Further, similarly, the cyan drum drive gear 42C is provided so that the phase thereof shifts by α° with respect to the phase of the magenta drum drive gear 42M, that is, shifts by 3α° with respect to the base phase.

According to this configuration, as shown in (c) of FIG. 4, when the sheet P is transported to the magenta photosensitive drum 17M, the phase of a contact point S3 of the magenta photosensitive drum 17M has reached the phase of the contact point S1 (0°) of the black photosensitive drum 17K shown in (a) of FIG. 4, whereby the contact point S3 of the magnet photosensitive drum 17M which corresponds to the contact point S1 of the black photosensitive drum 17K first comes into contact with the sheet P. Further, as shown in (d) of FIG. 4, when the sheet P is transported to cyan photosensitive drum 17C, the phase of a contact point S4 of the cyan photosensitive drum drive 17C has reached the phase of the contact point S1 (0°) of the black photosensitive drum 17K shown in (a) of FIG. 4, whereby the contact point S4 of the cyan photosensitive drum 17C which corresponds to the contact point S1 of the black photosensitive drum 17K first comes into contact with the sheet P.

Since the positions of the base phase points S1', S2', S3', S4' of the respective drum drive gears 42K, 42Y, 42M, 42C which corresponds to the contact points S1, S2, S3, S4, respectively, coincide with each other, the same gear teeth of the drum drive gears 42K, 42Y, 42M, 42C correspond to each other in the respective contact points. According to this configuration, even if the drum drive gears have an eccentric portion or an error in gear teeth, the phases of the black photosensitive drum 17K, the yellow photosensitive drum 17Y, the magenta photosensitive drum 17M and the cyan photosensitive drum 17C with respect to the sheet P can be synchronized with each other, and the circumferential speeds at the respective contact points can be made to coincide with each other. Therefore, in synergetic cooperation with that the integral multiples of the rotational cycles of the first intermediate gears 44 and the second intermediate gears 43 correspond to the time taken by each photosensitive drum 17 to rotate from the exposure position E to the transfer position T, the printing errors at the four photosensitive drums 17 can be reduced further.

3. Modified Exemplary Embodiments

Second Exemplary Embodiment

Figure 5:
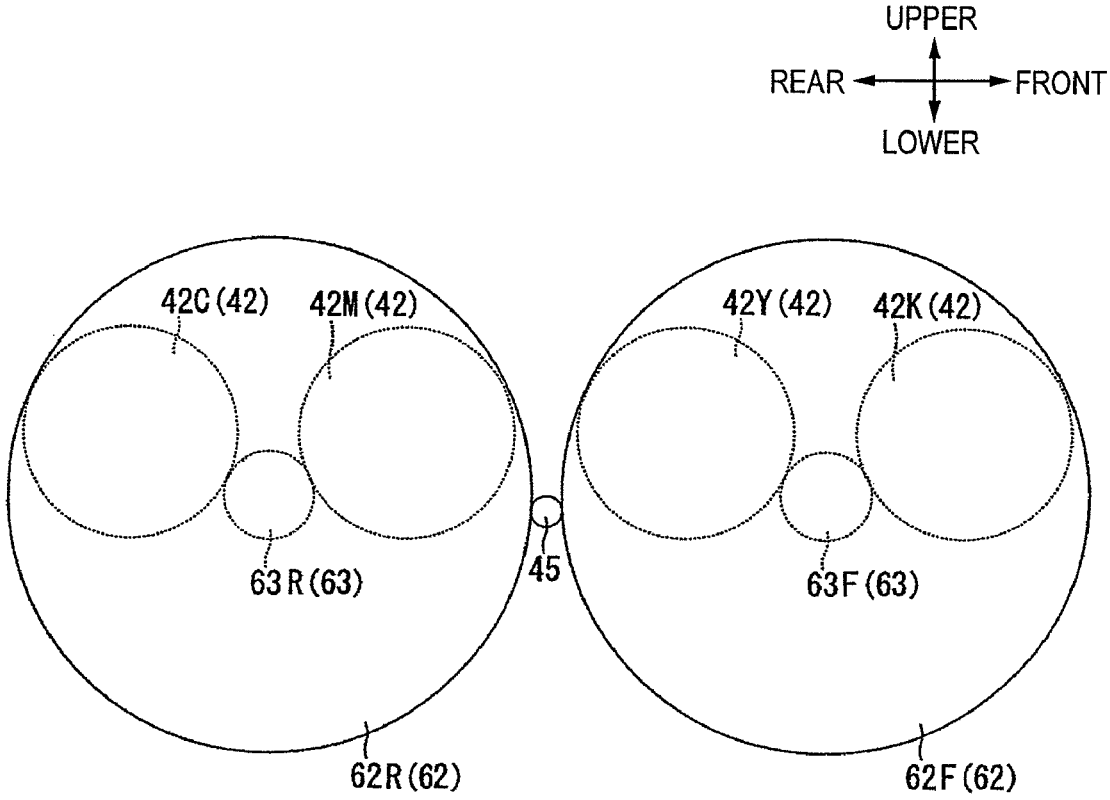
FIG. 5 is a schematic left side view of a gear train according to a second exemplary embodiment.

A gear train according to a second exemplary embodiment will be described with reference to FIG. 5. In FIG. 5, similar reference numerals are given to members similar to those of the first exemplary embodiment, and the description thereof will be omitted.

In the second exemplary embodiment, first intermediate gears 63 and second intermediate gears 62 are connected concentrically and integrally and are provided to correspond to the front and rear groups of drum drive gears 42. Hereinafter, when describing a positional relationship in the front-rear direction between both the intermediate gears, the first intermediate gear in a front position is referred to as a front first intermediate gear 63F, the second intermediate gear in a front position as a front second intermediate gear 62F, the first intermediate gear in a rear position as a rear first intermediate gear 63R, and the second intermediate gear in a rear position as a rear second intermediate gear 62R.

An axis of the front first intermediate gear 63F is provided at a center position between the black and yellow drum drive gears 42K, 42Y as viewed from the top, and the front first intermediate gear 63F meshes with the black and yellow drum drive gears 42K, 42Y. An axis of the rear first intermediate gear 63R is provided at a center position between the magenta and cyan drum drive gears 42M, 42C as viewed from the top, and the rear first intermediate gear 63R meshes with the magenta and cyan drum drive gears 42M, 42C. The front and rear second intermediate gears 62F, 62R mesh with a pinion gear 45 which is provide at a center position between the front and rear groups of drum drive gears 42.

That is, the gear train according to the second exemplary embodiment includes the first intermediate gears 63 and the second intermediate gears 62 which are arranged symmetrically with respect to the pinion gear 45, whereby a drive force is transmitted commonly to the black and yellow drum drive gears 42K, 42Y by the front first intermediate gear 63F and the front second intermediate gear 62F, while a drive force is transmitted commonly to the magenta and cyan drum drive gears 42M, 42C by the rear first intermediate gear 63R and the rear second intermediate gear 62R.

According to this configuration, similarly to the first exemplary embodiment, the four drum drive gears 42 can be molded by the same mold, and the two first intermediate gears 63 and the two second intermediate gears 62 can be molded integrally by the same mold, respectively. Further, errors in transmitting the drive force to the four drum drive gears 42K, 42Y, 42M, 42C can be reduced, and therefore, printing errors can be reduced.

Similarly to the first exemplary embodiment, the first intermediate gears 63 and the second intermediate gears are configured so that an integral multiple of rotational cycles of each of the intermediate gears corresponds to a time taken by each photosensitive drum 17 to rotate from the exposure position E to the transfer position T thereof.

Third Exemplary Embodiment

Figure 6:
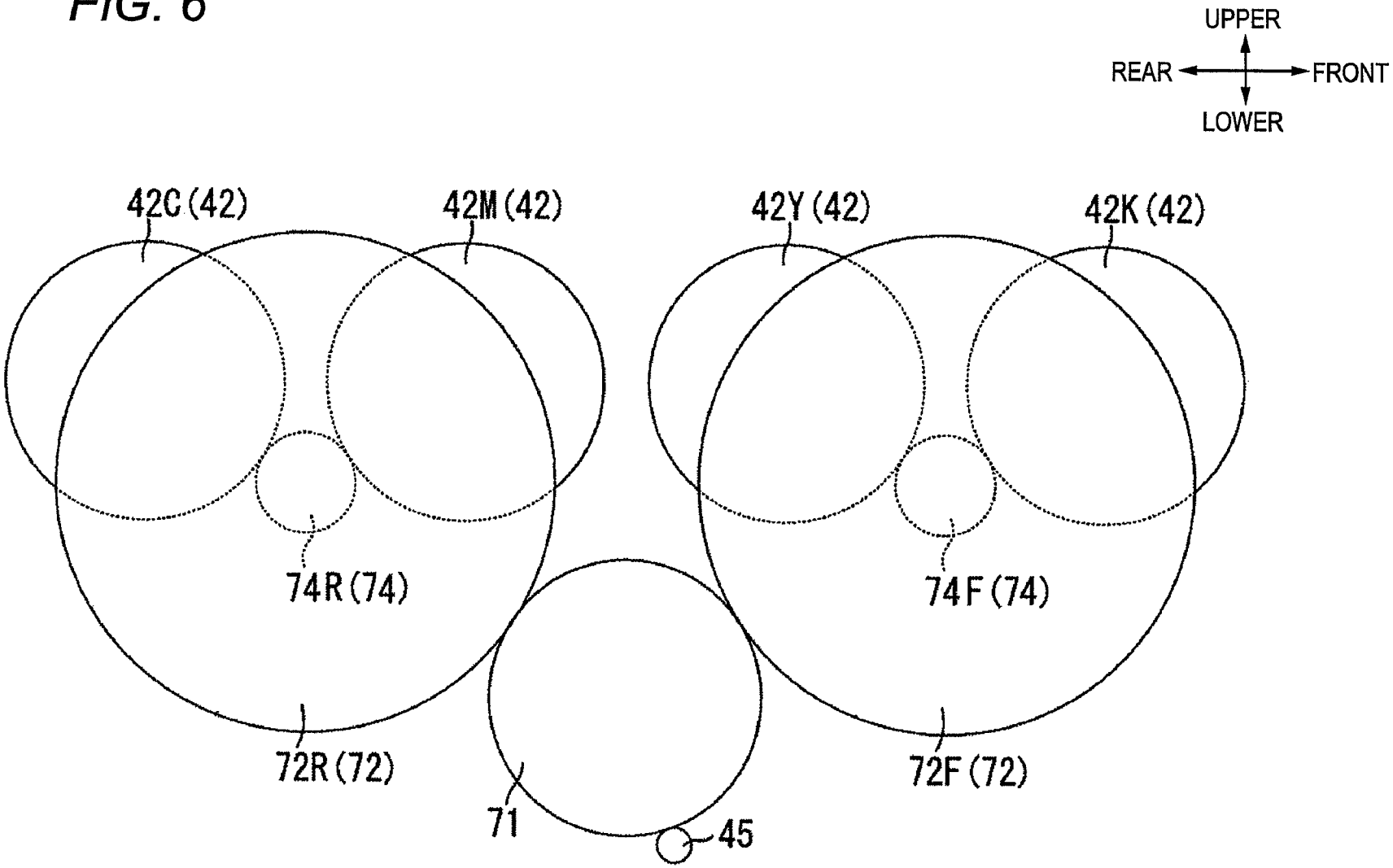
FIG. 6 is a schematic left side view of a gear train according to a third exemplary embodiment.

A gear train according to a third exemplary embodiment of the present invention will be described with reference to FIG. 6. In FIG. 6, similar reference numerals will be given to members similar to those of the first exemplary embodiment, and the description thereof will be omitted.

While in the first and second exemplary embodiments, the pinion gear 45 of the motor 41 meshes directly with the two second intermediate gears 43, 62, in the third exemplary embodiment, the pinion gear 45 is connected to two second intermediate gears via a third intermediate gear 71.

An axis of the third intermediate gear 71 is provided, as viewed from the top, at substantially center position in the arrangement direction of the four drum drive gears 42 between two adjacent groups of two drum drive gears when the four drum drive gears 42 are divided into the two groups. Further, the axis of the third intermediate gear 71 extends in parallel to axes of the drum drive gears 42. The third intermediate gear 71 meshes with front and rear second intermediate gears 72. The pinion gear 45 meshes with the third intermediate gear 71 in an arbitrary position other than a position which does not interfere with the second intermediate gears 72.

Similarly to the second exemplary embodiment, first intermediate gears 74 and the second intermediate gears 72 are formed concentrically and integrally, and similarly to the second exemplary embodiment, each of the first intermediate gears 74 meshes with each of the two groups of two drum drive gears 42. Hereinafter, when describing a positional relationship in a front-rear direction between the first and second intermediate gears, the first intermediate gear in a front position is referred to as a front first intermediate gear 74F, the second intermediate gear in a front position as a front second intermediate gear 72F, the first intermediate gear in a rear position as a rear first intermediate gear 74R, and the second intermediate gear in a rear position as a rear second intermediate gear 72R.

That is, the first intermediate gears 74 and the second intermediate gears 72 are arranged symmetrically with respect to the third intermediate gear 71. A drive force is transmitted commonly to the black and yellow drum drive gears 42K, 42Y by the front first intermediate gear 74F and the front second intermediate gear 72F, and a drive force is transmitted commonly to the magenta and cyan drum drive gears 42M, 42C by the rear first intermediate gear 74R and the rear second intermediate gear 72R.

According to this configuration, similarly to the second exemplary embodiment, the four drum drive gears 42 can be molded by the same mold, and the first intermediate gears 74 and the second intermediate gears 72 can be molded integrally by the same mold, respectively. Further, errors in transmitting the drive force to the four drum drive gears 42K, 42Y, 42M, 42C can be reduced, and therefore, printing errors can be reduced.

Similarly to the above-described exemplary embodiment, the first intermediate gears 74, the second intermediate gears 72 and the third intermediate gear 71 are configured so that an integral multiple of the rotational cycle corresponds to a time taken by each photosensitive drum 17 to rotate from the exposure position E to the transfer position T thereof.

Fourth Exemplary Embodiment

Figure 7:
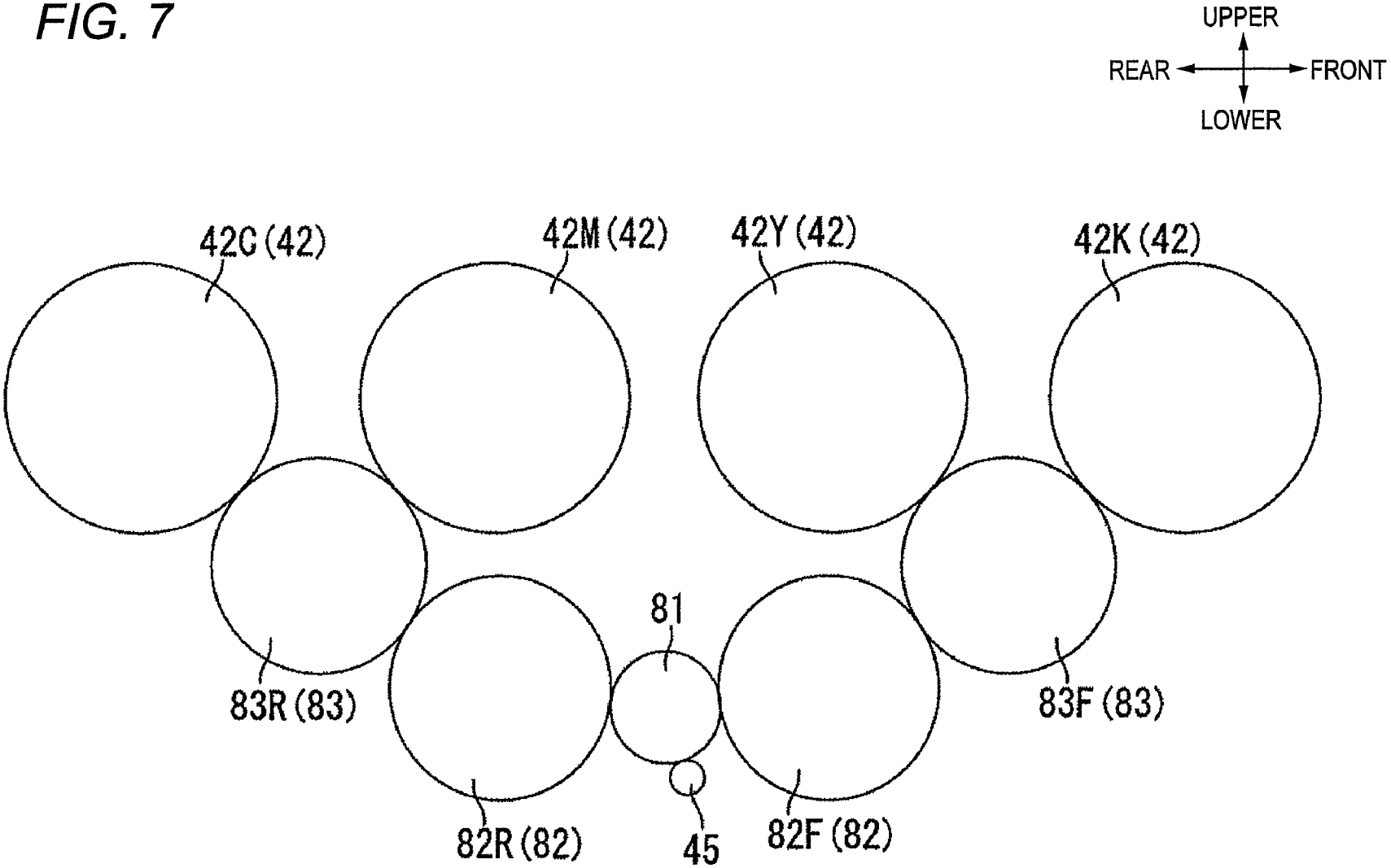
FIG. 7 is a schematic left side view of a gear train according to a fourth exemplary embodiment.

A gear train according to a fourth exemplary embodiment of the present invention will be described with reference to FIG. 7. In FIG. 7, similar reference numerals will be given to members similar to those of the first exemplary embodiment, and the description thereof will be omitted.

While in the first exemplary embodiment, the first intermediate gears 44 and the second intermediate gears 43 are connected to each other via the gear portions 46 which are provided concentrically and integrally with the first intermediate gears 44, in the fourth exemplary embodiment, the second intermediate gears mesh directly with first intermediate gears 44. Further, similarly to the third exemplary embodiment, the pinion gear 45 meshes with the second intermediate gears via a third intermediate gear 81.

The position of the third intermediate gear 81 with respect to a row of drum drive gears 42 is the same as that of the third intermediate gear of the third exemplary embodiment. Similarly to the above-described exemplary embodiments, first intermediate gears 83 are provided between the drum drive gears 42K and 42Y in the front group and between the drum drive gears 42M and 42C in the rear group, respectively, and mesh with the two drum drive gears 42 in the corresponding groups, respectively. The second intermediate gears 82 are provided further centrally or inwards in the arrangement direction of the drum drive gears 42. That is, the second intermediate gears 82 are provided closer to the third intermediate gear 81 than the first intermediate gears 83. The second intermediate gears 82 mesh with the first intermediate gears 83 and the third intermediate gear 81, respectively. Hereinafter, when describing a positional relationship in a front-rear direction between the first and second intermediate gears, the first intermediate gear in a front position is referred to as a front first intermediate gear 83F, the second intermediate gear in a front position as a front second intermediate gear 82F, the first intermediate gear in a rear position as a rear first intermediate gear 83R, and the second intermediate gear in a rear position as a rear second intermediate gear 82R.

That is, the first and second intermediate gears 83F, 82F for the front group including the drum drive gears 42K, 42Y and the first and second intermediate gears 83R, 82R for the rear group including the drum drive gears 42M, 42C are arranged symmetrically with respect to the third intermediate gear 81. Further, a drive force is transmitted commonly to the durum drive gears 42K, 42Y in the front group and transmitted commonly to the drum drive gears 42M, 42C in the rear group, by the first and second intermediate gears 83, 82. According to this configuration, errors in transmitting a drive force to the four drum drive gears, that is, the drum drive gears 42K, 42Y and the drum drive gears 42M, 42C can be reduced, and therefore, printing errors can be reduced. Further, the four drum drive gears 42, the front first intermediate gear 83F and the rear first intermediate gear 83R, and the front second intermediate gear 82F and the rear second intermediate gear 82R are formed as common parts and can be molded by the same molds, respectively.

Similarly to the above-described exemplary embodiment, the first intermediate gears 83, the second intermediate gears 82 and the third intermediate gear are configured so that an integral multiple of the rotational cycle corresponds to a time taken by each photosensitive drum 17 to rotate from the exposure position E to the transfer position T.

Fifth Exemplary Embodiment

Figure 8:
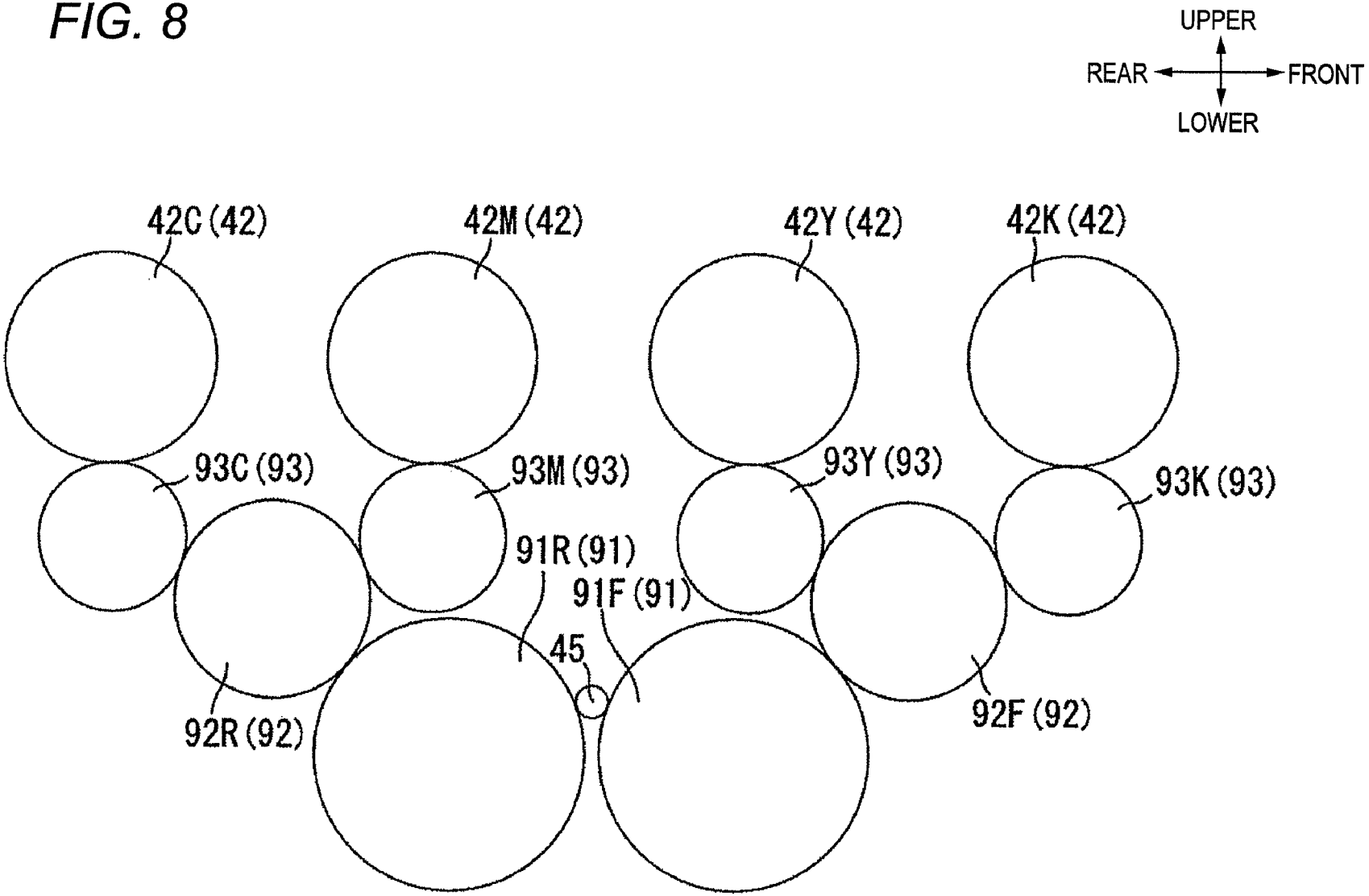
FIG. 8 is a schematic left side view of a gear train according to a fifth exemplary embodiment.

A gear train according to a fifth exemplary embodiment of the present invention will be described with reference to FIG. 8. In FIG. 8, similar reference numerals will be given to members similar to those of the first exemplary embodiment, and the description thereof will be omitted.

In the fifth exemplary embodiment, first intermediate gears 92 are provided correspondingly to the front and rear groups of drum drive gears 42. Hereinafter, when describing a positional relationship in a front-rear direction between the first intermediate gears, the first intermediate gear in a front position is referred to as a front first intermediate gear 92F, and the first intermediate gear in a rear position as a rear first intermediate gear 92R. The front first intermediate gear 92F meshes with the drum drive bears 42K, 42Y of front group via two gears 93K, 93Y which mesh with the drum drive gears 42K, 42Y, respectively. The rear first intermediate gear 92R meshes with the drum drive gears 42M, 42C of the rear group via two gears 93M, 93C which mesh with the drum drive gears 42M, 42C, respectively.

Similarly to the fourth exemplary embodiment, second intermediate gears 91 are provided further centrally or inwards in the arrangement direction of the drum drive gears 42. In other words, the second intermediate gears 91 are provided closer to the pinion gear 45 than the first intermediate gears 92. The pinion gear 45 is provided at a center position in the arrangement direction of the drum drive gears 42. Hereinafter, when describing a positional relationship in a front-rear direction between the second intermediate gears 91, the second intermediate gear in a front position is referred to as a front second intermediate gear 91F, and the second intermediate gear in a rear position as a rear second intermediate gear 91R.

Gears 93K, 93Y for the front group including the drum drive gears 42K, 42Y, the first and second intermediate gears 92F, 91F, and gears 93M, 93C for the rear group including the drum drive gears 42M, 42C are arranged symmetrically with respect to the pinion gear 45. Further, a drive force is transmitted commonly to the drum drive gears 42K, 42Y in the front group and transmitted commonly to the drum drive gears 42M, 42C in the rear group, by the first and second intermediate gears 92, 91. According to this configuration, errors in transmitting the drive force to the four drum drive gears, that is, the drum drive gears 42K, 42Y and the drum drive gears 42M, 42C can be reduced, and therefore, printing errors can be reduced. Further, the four drum drive gears 42, the four gears 93K, 93Y, 93M, 93C, the front first intermediate gear 92F and the rear first intermediate gear 92R, and the front second intermediate gear 91F and the rear second intermediate gear 91R are formed as common parts and can be molded by the same molds, respectively.

Similarly to the above-described exemplary embodiments, the four gears 93K, 93Y, 93M, 93C, the first intermediate gears 92 and the second intermediate gears 91 are configured so that an integral multiple of the rotational cycle corresponds to a time taken by each photosensitive drum 17 to rotate from the exposure position E to the transfer position T thereof.

Sixth Exemplary Embodiment

Figure 9:
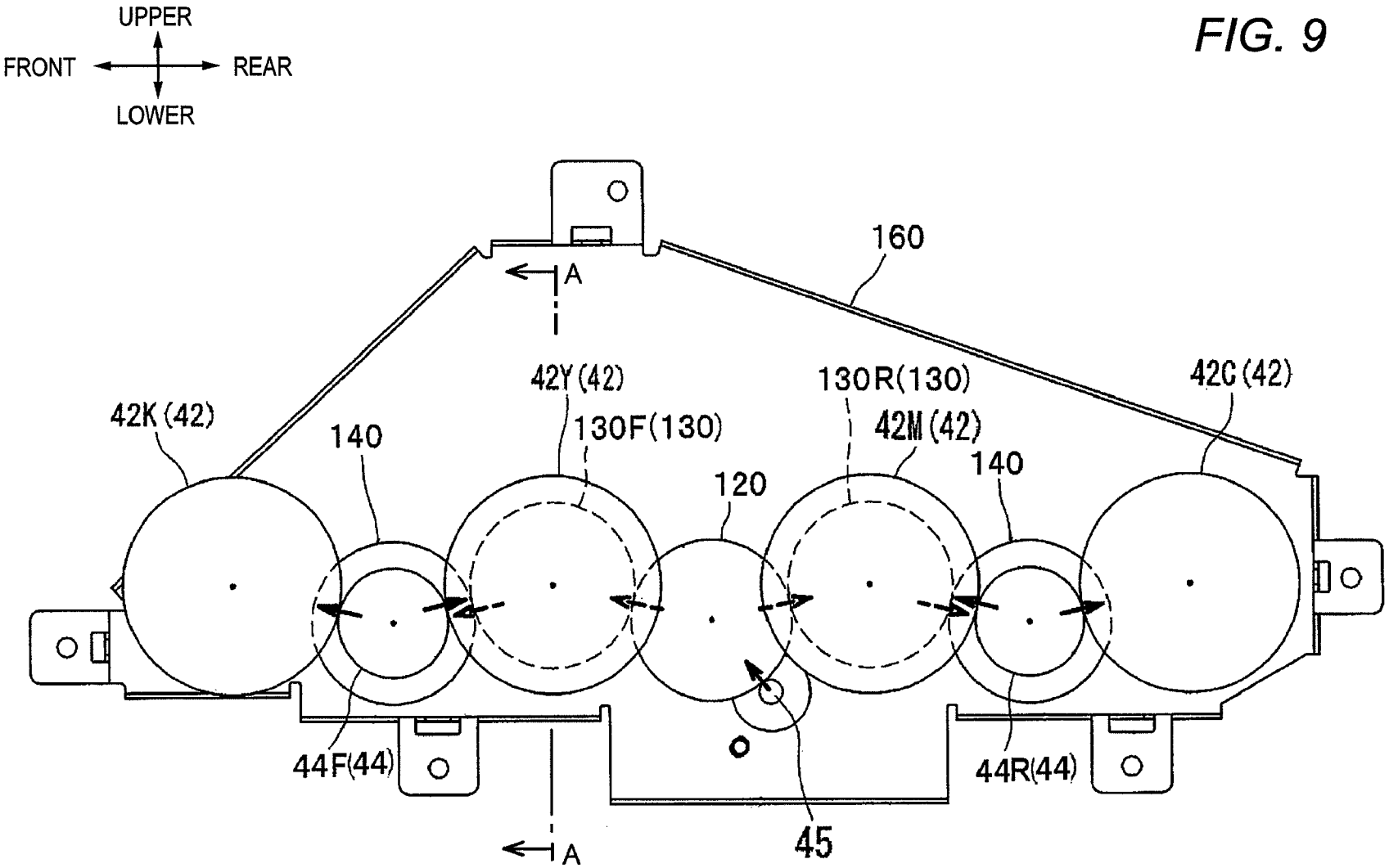
FIG. 9 is a schematic left side view of a gear train according to a sixth exemplary embodiment.

A gear train according to a sixth exemplary embodiment will be described with reference to FIG. 9. In FIG. 9, similar reference numerals will be given to members similar to those of the first exemplary embodiment, and the description thereof will be omitted. While FIGS. 2 and 5 to 8 show the gear train when viewed from the opposite side to the photosensitive drum 17, FIG. 9 shows a gear train when viewed from a photosensitive drum side. Therefore, in FIG. 9, the gear train is shown other way round with respect to a front-rear direction when compared with the gear train shown in FIGS. 2 and 5 to 8.

In the sixth exemplary embodiment, similarly to the first exemplary embodiment, gear portions 140 are provided concentrically and integrally with first intermediate gears 44, and second intermediate gears 130 are provided to mesh with the corresponding gear portions 140, respectively. Further, similarly to the third exemplary embodiment (FIG. 6), a third intermediate gear 120 is provided at a center position in the arrangement direction of the drum drive gears 42.

Similarly to the first exemplary embodiment, the first intermediate gears 44 are provide between drum drive gears 42K and 42Y in the front group and between drum drive gears 42M and 42C in the rear group, respectively. The first intermediate gears 44 mesh with the two drum drive gears in the corresponding groups, respectively. Each of the second intermediate gears 130 are provided concentrically with one of the drum drive gears 42 which is provided more centrally in the arrangement direction of the drum drive gears 42 among the two drum drive gears 42 meshing with one first intermediate gear 44. The second intermediate gears 130 are supported to be rotatable relative to the drum drive gears 42 provided concentrically therewith. Specifically, the second intermediate gear 130F in a front position is provided concentrically with the yellow drum drive gear 42Y to rotatable freely, and the second intermediate gear 130R in a rear position is provided concentrically with the magenta drum drive gear 42M to be rotatable freely.

The third intermediate gear 120 meshes with the front and rear second intermediate gears 130F, 130R. The pinion gear 45 of the motor meshes with the third intermediate gear 120.

That is, the first intermediate gear 44F, the gear portion 140 and the second intermediate gear 130F for the front group including the drum drive gears 42K, 42Y and the first intermediate gear 44R, the gear portion 140 and the second intermediate gear 130R for the rear group including the drum drive gears 42M, 42C are arranged symmetrically with respect to the third intermediate gear 120. Further, a drive force is commonly transmitted to the drum drive gears 42K, 42Y in the front group and transmitted commonly to the drum drive gears 42M, 42C in the rear group, via the first intermediate gears 44, the gear portions 140 and the second intermediate gears 130, respectively. According to this configuration, errors in transmitting the drive force to the four drum drive gears 42, that is, the drum drive gears 42K, 42Y and the drum drive gears 42M, 42C can be reduced, and therefore, printing errors can be reduced. Further, the four drum drive gears 42, the front and rear first intermediate gears 44 and the gear portions 140 and the front and rear second intermediate gears 130 are formed as common parts and can be molded by the same molds.

The number of teeth of the first intermediate gear 44 is set so be the same as the numbers of teeth of the second intermediate gear 130 and the third intermediate gear 120, so that each of the gear teeth meshes with one corresponding gear tooth at all times. In other words, combinations of gear teeth which mesh with each other become same at all times. The number of teeth of the first intermediate gear 44 is set so that an integral multiple thereof becomes the same as the number of teeth of the drum drive gear 42, and each gear teeth of the drum drive gear 42 meshes with one corresponding gear tooth of the first intermediate gear 44 at all times. According to this configuration, even if the drum drive gears have an eccentric portion or an error in gear teeth, errors in transmitting the drive force to the drum drive gears can be reduced, and therefore, printing errors can be reduced.

Figure 10:
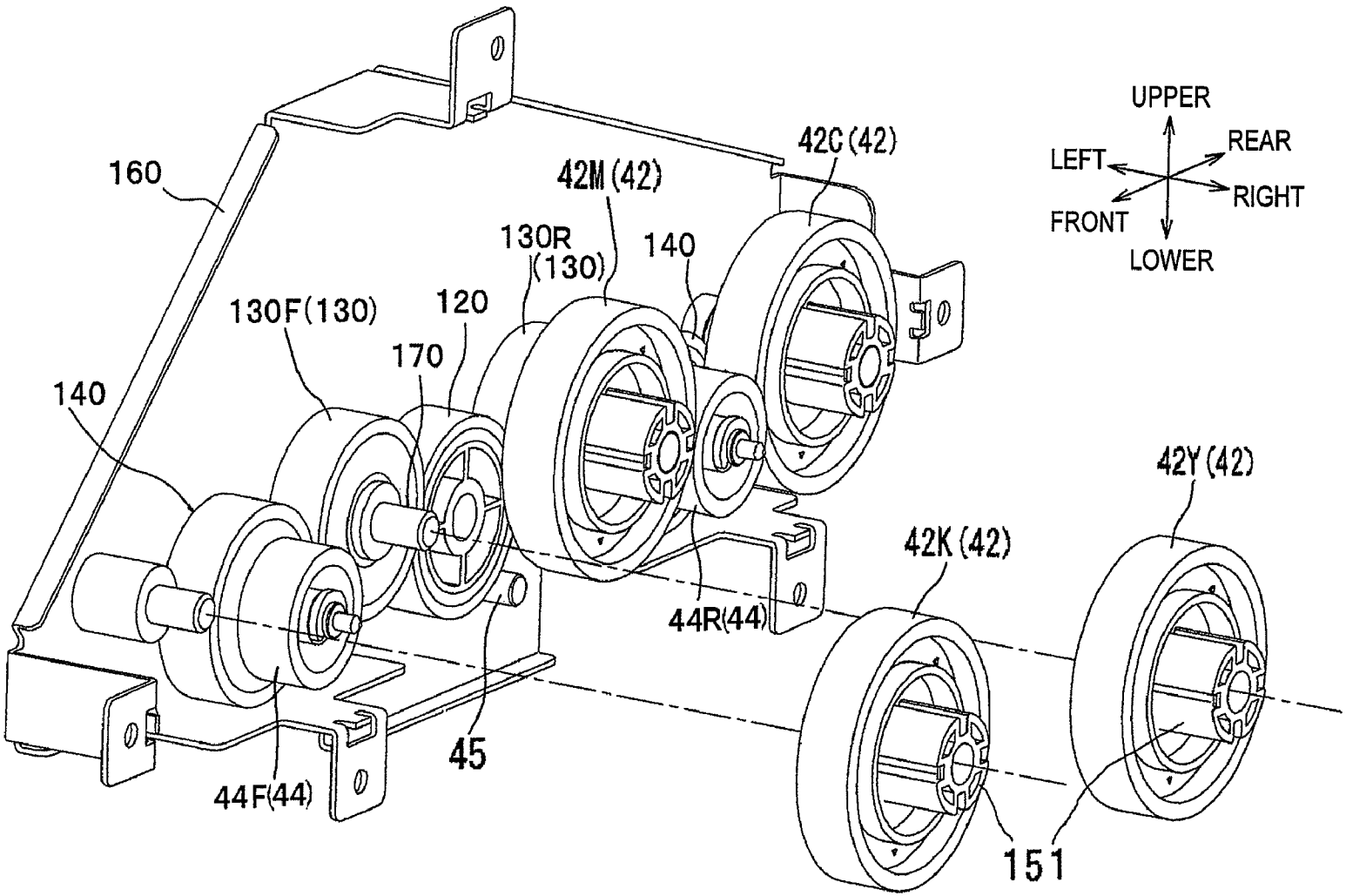
FIG. 10 is a perspective view of the gear train according to the sixth exemplary embodiment.

In the sixth exemplary embodiment, the gears 42, 44, 120, 130, 140 and the motor having the pinion gear 45 are supported on a single support plate 160. Specifically, as shown in FIGS. 10 and 11, a plurality of support shafts 170 are fixed to the support plate 160 at one ends thereof by caulking, and the gears 42, 44, 120, 130, 140 are supported rotatably on the corresponding support shafts 170, respectively.

Figure 11:
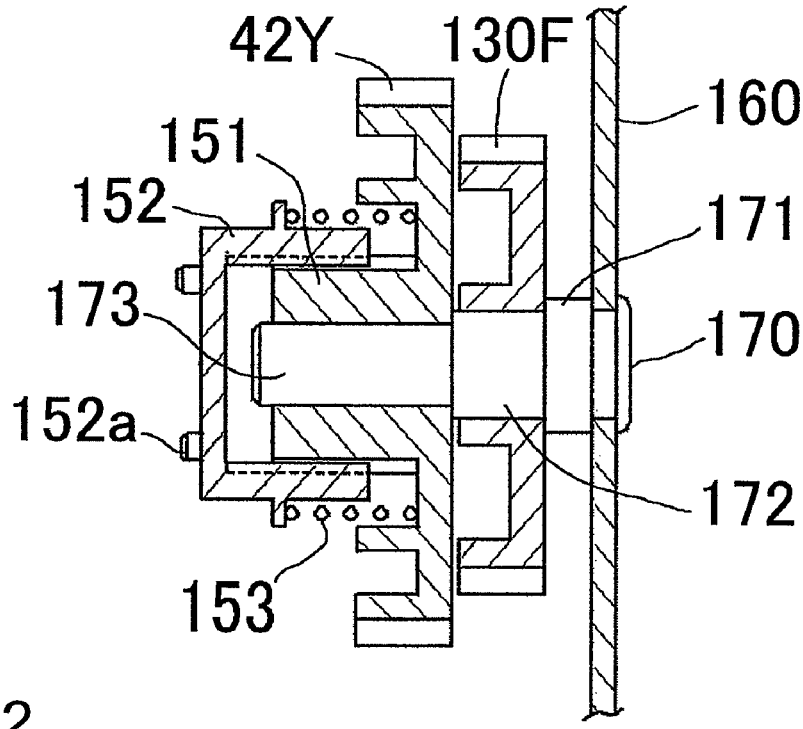
FIG. 11 is a sectional view taken along the line A-A in FIG. 10.

As shown in FIG. 11, among these support shafts, each of the support shafts 170 which support the yellow and magenta drum drive gears 42Y, 42M and the second intermediate gears 130F, 130R includes a large diameter portion 171, an intermediate diameter portion 172 and a small diameter portion 173 whose diameters reduce sequentially from the support plate 160 side. The second intermediate gears 130F, 130R are supported rotatably on the intermediate gear portions 172, and the yellow and magenta drum drive gears 42Y, 42M are supported rotatably on the small diameter portions 173, respectively.

It is advantageous that the yellow and magenta drum drive gears 42Y, 42M and the second intermediate gears 130F, 130R are formed as helical gears which have gear teeth inclined so as to generate a trust force toward the support plate 160, whereby the gears are brought into abutment with end faces of the adjacent intermediate diameter portions 172 or large diameter portions 171 so as to be positioned. Further, according to this configuration, spaces between the support plate 160 and the gears and between the two adjacent gears are held.

Figure 12:
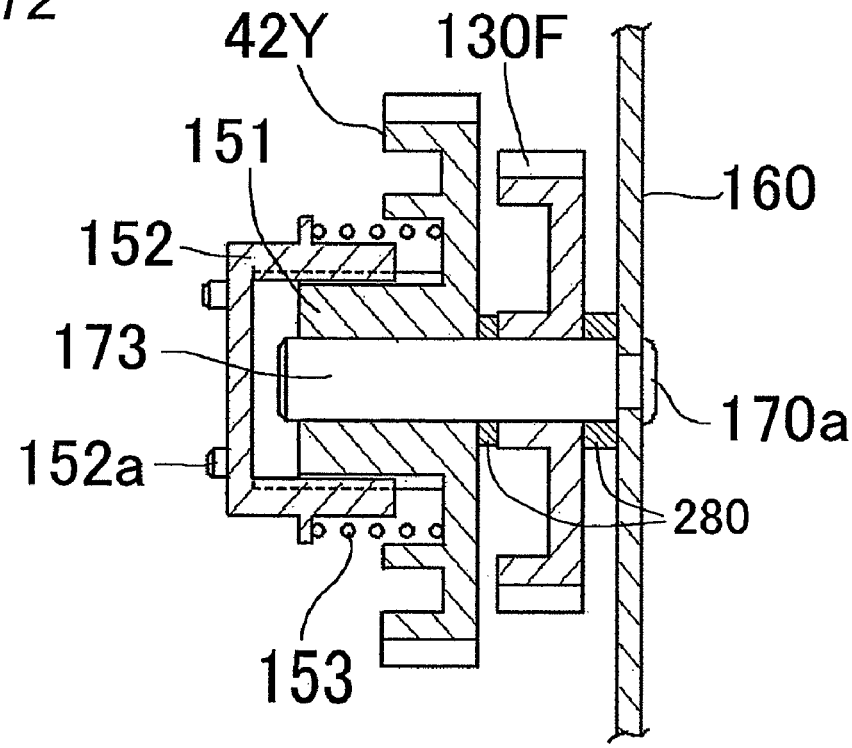
FIG. 12 is a sectional view showing a modified example to the configuration shown in FIG. 11.

The support shafts which support the drum drive gears 42Y, 42M and the second intermediate gears 130F, 130R can be configured as shown in FIG. 12. In a support shaft 170*a* in FIG. 12, a portion which supports the two gears has the same diameter. A space regulating members 280 is provided between the second intermediate gears 130F, 130R and the drum drive gears 42Y, 42M, respectively. In this case, the drum drive gears 42Y, 42M and the second intermediate gears 130F, 130R are formed as helical gears which have gear teeth inclined oppositely to each other so as to generate a thrust force toward the space regulating member 280 provided between both the gears, whereby both the gears are positioned by virtue of the generated thrust force. In order to improve the assembling properties of the second intermediate gears 130F, 130R, the space regulating member 280 may also be disposed between the support plate 160 and the second intermediate gear 130F, 130R.

Further, the four drum drive gears 42 include cylindrical connecting portions 151 which project toward corresponding photosensitive drums 17 in parallel to the axis thereof, respectively. A connecting member 152 is fitted on the connecting portion 151 to be rotatable together with the connecting portion 151 in a rotational direction and to slide in a direction parallel to the axis direction thereof. The connecting member 152 includes two projecting portions 152*a* which are provided in radially spaced apart positions on the photosensitive drum 17 side end face thereof so as to project toward the photosensitive drum 17 side. The connecting member 152 is urged by a spring 153 in a direction in which the projecting portions 152*a* are fitted in the through holes in the coupling plate 54 of the photosensitive drum 17 shown in FIG. 3 and the projecting portions 152*a* are released from the fitment with the coupling plate 54 by a related-art advancing and retreating mechanism.

Seventh Exemplary Embodiment

Figure 13:
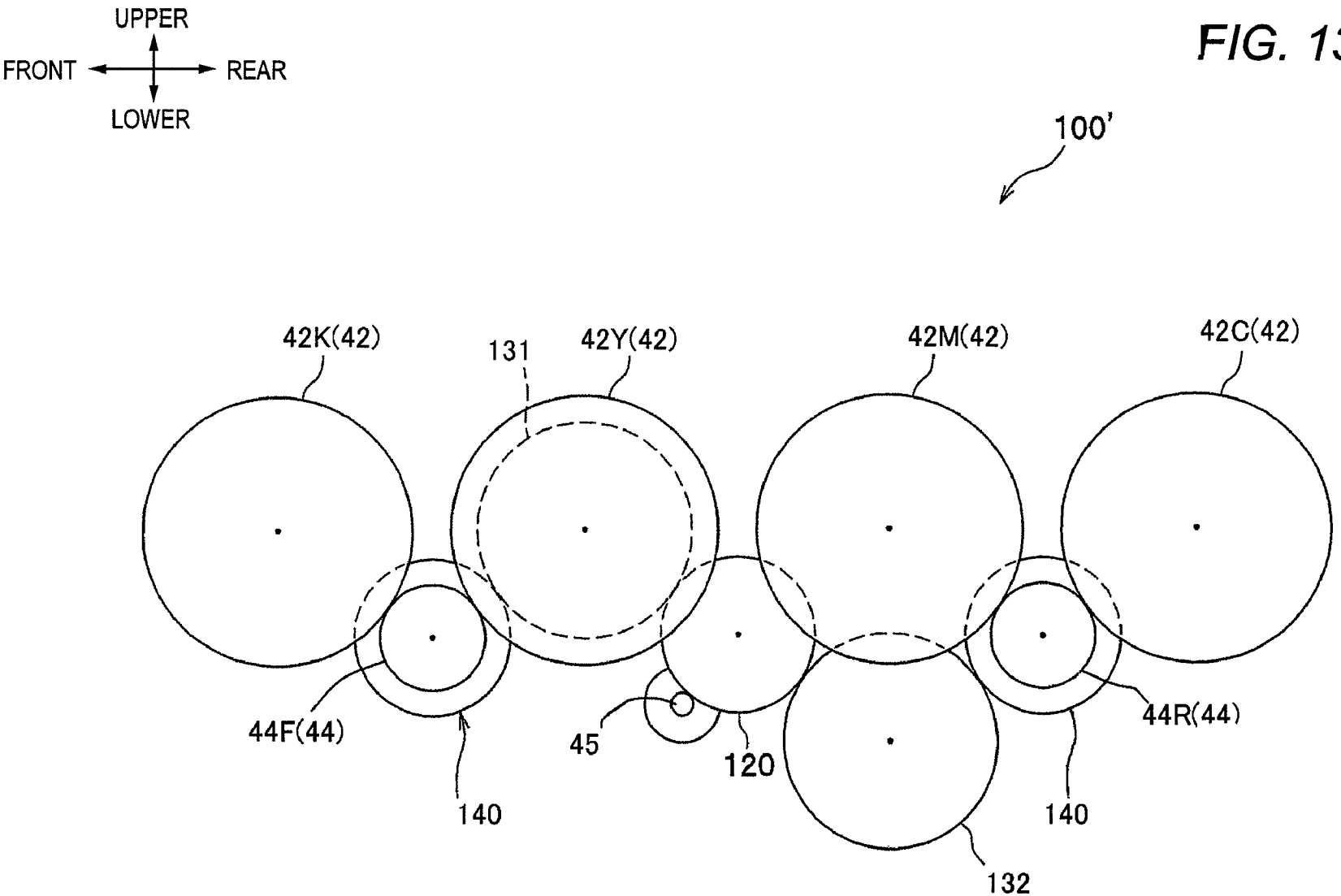
FIG. 13 is a schematic right side view of a gear train according to a seventh exemplary embodiment.

A gear train according to a seventh exemplary embodiment will be described with reference to FIG. 13. In FIG. 13, similar reference numerals will be given to members similar to those of the sixth exemplary embodiment, and the description thereof will be omitted.

The seventh exemplary embodiment is such that in the sixth embodiment, a rear second intermediate gear 132 is not provided concentrically with the magenta drum drive gear 42M but is disposed below the drum drive gear 42M.

Further Modified Exemplary Embodiments

In the above-described exemplary embodiments, whether the third intermediate gear is used or the pinion gear meshes directly with the second intermediate gear without using the third intermediate gear is optional.

Although there will be no problem even if the number of teeth of the drum drive gears and the numbers of teeth of the intermediate gears are set arbitrarily, it is advantageous that the number of teeth is set so that the distance from the exposure position E to the transfer position T of the photosensitive drum 17 corresponds to an integral multiple of the rotation of an intermediate gear or that the number of teeth of the drum drive gears corresponds to an integral multiple of the intermediate gears, as described above. In the above-described exemplary embodiments, the integral multiple is optional.

While in FIGS. 3 and 11, the exemplary embodiments are shown in which the photosensitive drums are concentrically connected with the drum drive gears in the detachable manner, a configuration can be adopted in which gears which are connected integrally with the photosensitive drums mesh with outer circumferences of the drum drive gears in a detachable manner or in which the drum drive gears are connected integrally with the photosensitive drums, and the drum drive gears and the intermediate gears mesh with each other in the detachable manner.

What is claimed is:

1. An image forming apparatus comprising:

a single drive source;

at least four photosensitive drums;

a plurality of drum drive gears which are provided to correspond to the photosensitive drums; and a plurality of intermediate gears which are interposed between the drive source and each of the drum drive gears, wherein a number of the intermediate gears provided for each of the photosensitive drums is same;

wherein each of the photosensitive drums is rotated through an exposure position at which after a surface of the photosensitive drum is charged, the surface of the photosensitive drum is exposed, so that an electrostatic latent image is formed thereon; and a transfer position at which after a developer image is formed on the surface of the photosensitive drum based on the electrostatic latent image, the developer image is transferred on to a member, and wherein, while the photosensitive drum rotates from the exposure position to the transfer position, each of the intermediate gears rotates one or more complete rotations.

2. The image forming apparatus according to claim 1, wherein the four photosensitive drums are arranged with an interval therebetween along a substantially straight line extending in an arrangement direction which is substantially orthogonal to axes thereof, the axes of the photosensitive drums extending parallel to each other, wherein when the four drum drive gears being divided into two groups each including two adjacent drum drive gears, a same number of the intermediate gears are provided for each of the two groups, the intermediate gears of the two groups are arranged symmetrically with respect to a substantially center position between the two groups in the arrangement direction, and wherein the drive source supplies a drive force to intermediate gears provided closer to the center position in the arrangement direction among the intermediate gears arranged substantially symmetrical with each other.

3. The image forming apparatus according to claim 2, wherein the intermediate gears include a plurality of gears which transmit the drive force commonly to the two drum drive gears of each of the groups.

4. An image forming apparatus comprising:

four drum drive gears which are connectable to one ends of four photosensitive drums in an axis direction thereof, respectively, and which are arranged at an interval therebetween along a substantially straight line extending in an arrangement direction which is substantially orthogonal to the axes of the drum drive gears, the axes of the drum drive gears extending parallel to each other;

a single drive source which supplies a drive force to the photosensitive drums to rotate about the axes thereof, respectively; and a plurality of intermediate gears which are interposed between the drive source and each of the drum drive gears, wherein when the four drum drive gears are divided into two groups, each including two adjacent drum drive gears, a gear non-rotatably connected to the drive source is provided at a substantially center position between the two groups in the arrangement direction, and wherein the plurality of intermediate gears include:

a first intermediate gear which is provided for each of the two groups and meshes with the two drum drive gears of the corresponding group, and a second intermediate gear which is provided for each of the two groups and connects the first intermediate gear for the corresponding group with the gear non-rotatably connected to the drive source.

5. The image forming apparatus according to claim 4, wherein the second intermediate gears are provided concentrically with the first intermediate gears, respectively.

6. The image forming apparatus according to claim 4, wherein each of the first intermediate gears is configured as a single gear which meshes with the drum drive gears of a corresponding group via two gears which mesh with the two drum drive gears of the corresponding group, respectively.

7. An image forming apparatus comprising:

four drum drive gears which are connectable to one ends of four photosensitive drums in an axis direction thereof, respectively, and which are arranged at an interval therebetween along a substantially straight line extending in an arrangement direction which is substantially orthogonal to the axes of the drum drive gears, the axes of the drum drive gears extending parallel to each other;

a single drive source which supplies a drive force to the photosensitive drums to rotate about the axes thereof, respectively; and a plurality of intermediate gears which are interposed between the drive source and each of the drum drive gears, wherein the plurality of intermediate gears include:

a first intermediate gear which is provided for each of two groups into which the four drum drive gears are divided, each group including two adjacent drum drive gears, and which meshes with the two drum drive gears of the corresponding group;

a second intermediate gear which is provided for each of the two groups and is connected to the first intermediate gear for the corresponding group; and a third intermediate gear which is provided at a substantially center position between the two groups in the arrangement direction, and which connects the second intermediate gears with a gear non-rotatably connected to the drive source.

8. The image forming apparatus according to claim 7, wherein the second intermediate gears are provided closer to the center position than the first intermediate gears in the arrangement direction, respectively.

9. The image forming apparatus according to claim 8, wherein each of the second intermediate gears is provided concentrically with the drum drive gear which is provided closer to the center position among the two drum drive gears of the corresponding group, and is rotatable relative to the drum drive gear.

10. The image forming apparatus according to claim 8, wherein a gear portion is connected concentrically and integrally to each of the first intermediate gears and meshes with a corresponding second intermediate gear.

11. The image forming apparatus according to claim 7, wherein each of the first intermediate gears is configured as a single gear which is provided at a substantially center position between the two drum drive gears of the corresponding group in the arrangement direction, and which meshes commonly with the two drum drive gears.

12. The image forming apparatus according to claim 7, wherein the first intermediate gear and the second intermediate gear for one of the two groups and the first intermediate gear and the second intermediate gear for the other of the two groups are arranged substantially symmetrically with respect to the center position in the arrangement direction.

13. The image forming apparatus according to claim 7, wherein the drum drive gears and the intermediate gears are supported on a single support plate.

14. The image forming apparatus according to claim 7, wherein the intermediate gears which are provided at a same sequential number from the drive source are molded by a same mold.

15. The image forming apparatus according to claim 7, wherein a number of teeth of each of the drum drive gears is an integral multiple of a number of teeth of the first intermediate gear which mesh with the drum drive gear.

16. The image forming apparatus according to claim 7, wherein the drum drive gears are provided at a same position in the axis direction of the photosensitive drums.

17. An image forming apparatus comprising:

a single drive source;

photosensitive drums;

a plurality of drum drive gears which are provided to correspond to the photosensitive drums; and a plurality of intermediate gears which are interposed between the drive source and each of the drum drive gears, wherein a number of the intermediate gears provided for each of the photosensitive drums is same;

wherein one of the intermediate gears is provided concentrically with one of the drum drive gears, and the concentrically-provided intermediate gear is rotatable relative to the one of the drum drive gears.

18. The image forming apparatus according to claim 17, wherein the photosensitive drums are arranged with an interval therebetween along a substantially straight line extending in an arrangement direction which is substantially orthogonal to axes thereof, the axes of the photosensitive drums extending parallel to each other, wherein when the drum drive gears being divided into two groups each including two adjacent drum drive gears, a same number of the intermediate gears are provided for each of the two groups, the intermediate gears of the two groups are arranged symmetrically with respect to a substantially center position between the two groups in the arrangement direction, and wherein the drive source supplies a drive force to intermediate gears provided closer to the center position in the arrangement direction among the intermediate gears arranged substantially symmetrical with each other.

19. The image forming apparatus according to claim 18, wherein the intermediate gears include a plurality of gears which transmit the drive force commonly to the two drum drive gears of each of the groups.

20. The image forming apparatus according to claim 17, wherein the plurality of intermediate gears include:

a first intermediate gear which is provided for each of two groups into which the four drum drive gears are divided, each group including two adjacent drum drive gears, and which meshes with the two drum drive gears of the corresponding group;

a second intermediate gear which is provided for each of the two groups and is connected to the first intermediate gear for the corresponding group; and a third intermediate gear which is provided at a substantially center position between the two groups in the arrangement direction, and which connects the second intermediate gears with a gear non-rotatably connected to the drive source.

* * * * *